US005247799A

United States Patent [19]

Lindl

[11] Patent Number: 5,247,799

[45] Date of Patent: Sep. 28, 1993

[54] REGENERATIVE GAS REFRIGERATING MACHINE

[75] Inventor: Bruno Lindl, Laufach, Fed. Rep. of Germany

[73] Assignee: Licentia Patent-Verwaltungs GmbH, Frankfurt, Fed. Rep. of Germany

[21] Appl. No.: 797,219

[22] Filed: Nov. 25, 1991

[30] Foreign Application Priority Data

Nov. 28, 1990 [DE] Fed. Rep. of Germany ..... 4037826

[51] Int. Cl.[5] ..... F25B 9/14

[52] U.S. Cl. ..... 62/6

[58] Field of Search ..... 62/6

[56] References Cited

U.S. PATENT DOCUMENTS 4,375,749 3/1983 Ishizaki ..... 62/6

4,455,841 6/1984 Wurm ..... 62/6

*Primary Examiner*—Allen J. Flanigan

*Attorney, Agent, or Firm*—McGlew and Tuttle

[57] ABSTRACT

To set defined final temperatures of a regenerative gas refrigerating machine, it is suggested that a control gas with defined partial pressure be added to the working gas as a heat exchange medium in the circuit.

15 Claims, 5 Drawing Sheets

REGENERATIVE GAS REFRIGERATING MACHINE

FIELD OF THE INVENTION

The present invention pertains to a regenerative gas refrigerating machine with a working gas circulating in a circuit and more particularly to a regenerative gas refrigerating machine used to generate cryogenic temperatures.

BACKGROUND OF THE INVENTION

Regenerative gas refrigerating machines are used to generate cryogenic temperatures. They operate according to the principle of a thermodynamic cyclic process. The working gas exchanges heat between the two temperature levels in a regenerator (FIG. 1). The parameters for the refrigerating capacity and consequently for the maximum attainable final temperature are the gas mass participating in one cyclic process and the number of cyclic processes run through per unit time.

To reach the most constant final temperature possible with such a gas refrigerating machine for certain applications, it has been suggested that the final temperature be limited by electrically controlling the input power. This possibility of control is relatively expensive and prone to malfunction.

SUMMARY AND OBJECTS OF THE INVENTION

It is a primary object of the present invention to make it possible to maintain in final temperature extensively constant in the gas refrigerating machine mentioned in the introduction by simple means.

According to the invention, a regenerative gas refrigerating machine and process are provided employing a working gas circulating in a circuit wherein another gas component, acting as a control gas with a defined partial pressure, is admixed to the working gas in order to limit the desired final temperature that can be produced. The final temperatures may be set by selecting a type of control gas as well as the partial pressure of the control gas to be mixed with the working gas. Helium may be used as the working gas and it is possible to use a gas mixture as the control gas, or to use a single gas component as the control gas such as oxygen and/or nitrogen and/or argon. A hydrocarbon may also be used as the control gas such as propane.

The described admixture of a control gas brings about an extremely constant final temperature with very simple means. This final temperature practically corresponds to the triple point temperature in the phase diagram of the control gas. It depends on the control gas selected and its partial pressure, which means that it is possible to set or adjust the final temperatures of the gas refrigerating machine. The final temperature can be selected within broad limits by properly selecting the type of the working gas and that of the control gas. The final temperature is determined, to some extent, by a natural inherent constant based on the characteristics of the control gas and its relation to the working gas.

A further object of the invention is to provide a simple and accurate mechanism for maintaining a final temperature extensively constant in a gas refrigerating machine.

The various features of novelty which characterize the invention are pointed out with particularity in the claims annexed to and forming a part of this disclosure.

For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
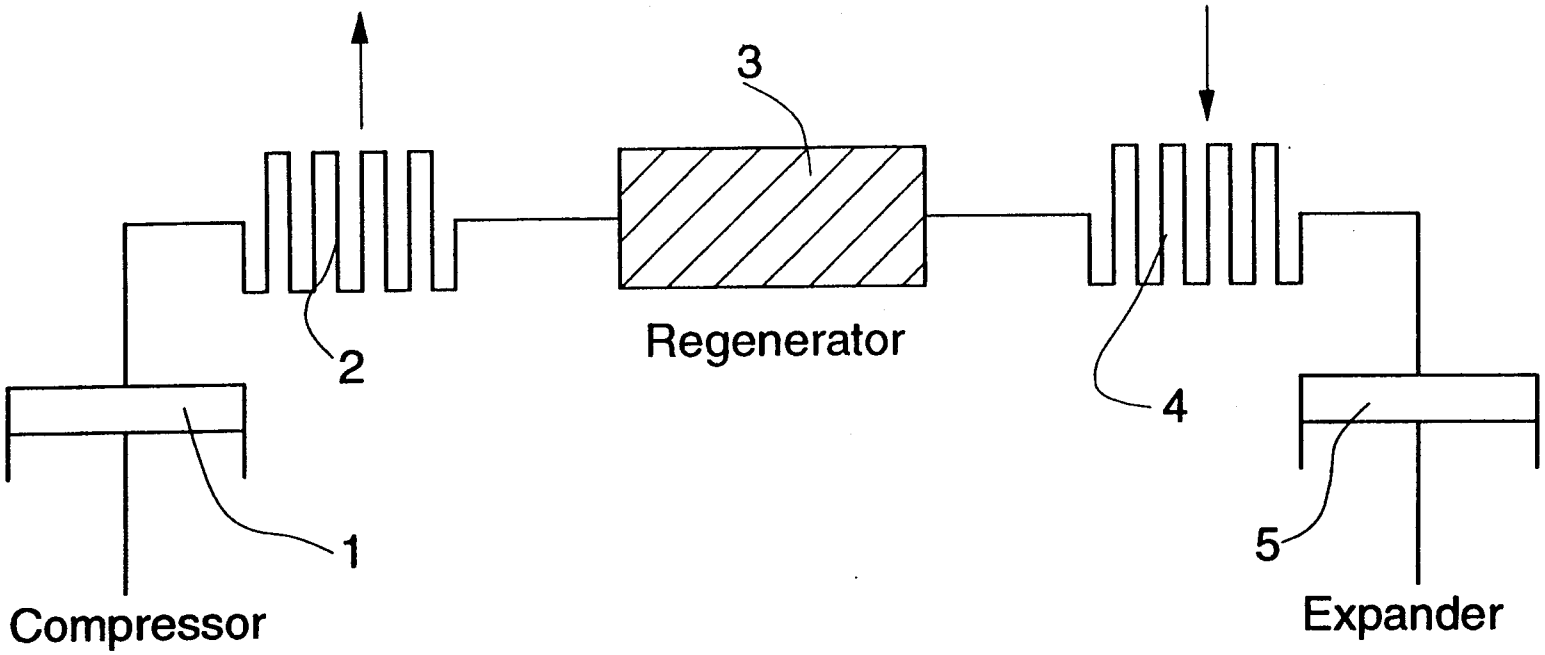
FIG. 1 is a circuit diagram of the refrigerating machine according to the invention.

Referring to the drawings in particular, the invention comprises a refrigerating machine as shown in FIG. 1 wherein a working gas is circulated in the circuit and another gas component, acting as a control gas with a defined partial pressure, is admixed to the working gas in order to limit the final temperature to a temperature higher than that which would be produced with just the working gas alone. The final temperature may be set by selecting the working gas and the control gas, as well as the partial pressure of the control gas.

FIG. 1 schematically shows a block diagram of a gas refrigerating machine with a compressor 1, a heat-releasing heat exchanger 2, a regenerator 3, a heat-absorbing heat exchanger 4, and an expander 5. According to the invention, the gas circuit 10 is filled with a working gas (see examples below) and has a limit means including another gas component acting as a control gas wherein the control gas has a defined partial pressure and is admixed to the working gas for limiting the minimum final or desired temperature that can be produced.

Figure 2:
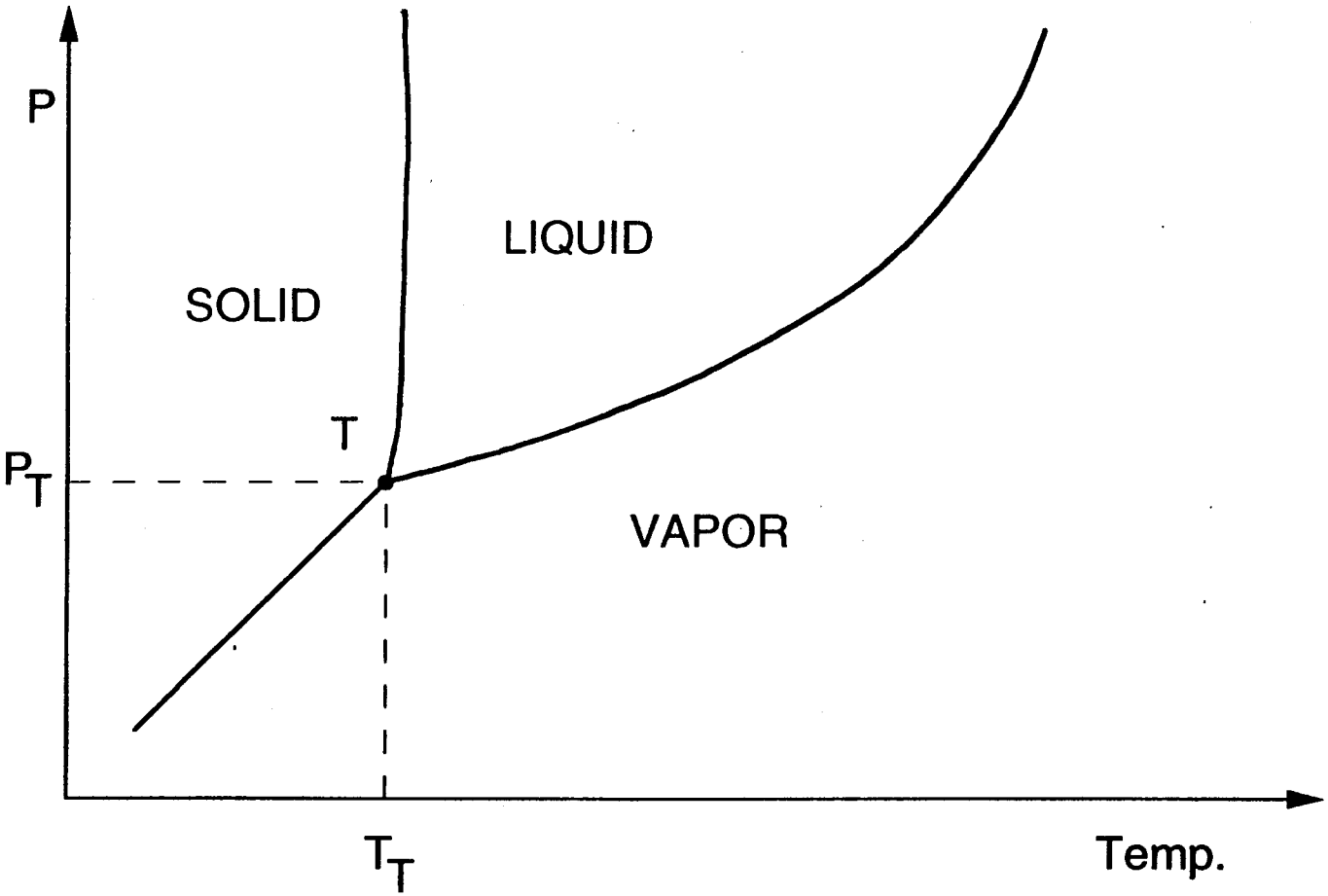
FIG. 2 is a graph showing a phase diagram of the three states of the control gas showing pressure as a function of temperature.

FIG. 2 shows the gas pressure P as a function of the temperature over the Temp. axis. In the phase diagram of the three states of aggregation of the control gas described, the triple point T appears at a triple point pressure $P_T$ and a triple point temperature $T_T$.

It is at this triple point temperature that the lower limit of the gas refrigerating machine is set or adjusted to. Therefore by selecting different control gases with different partial pressures, the lower limit of a gas refrigerating machine can be adjusted.

The control gas freezes out at the triple point temperature (see FIG. 2) in the regenerator 3 of the machine (see FIG 1). This reduces the cooling capacity at this temperature level and the lower temperature that the refrigeration machine can obtain is limited. If the thermal load increases in temperature, the control gas changes into a gaseous aggregation and the refrigerating machine will regain its cooling capacity and the temperature will remain stable. The fluctuations in the temperature of the thermal load is very small (see FIG.

4). The mass of the control gas is of course a minor fraction in the circuit with respect to the working gas.

Figure 3:
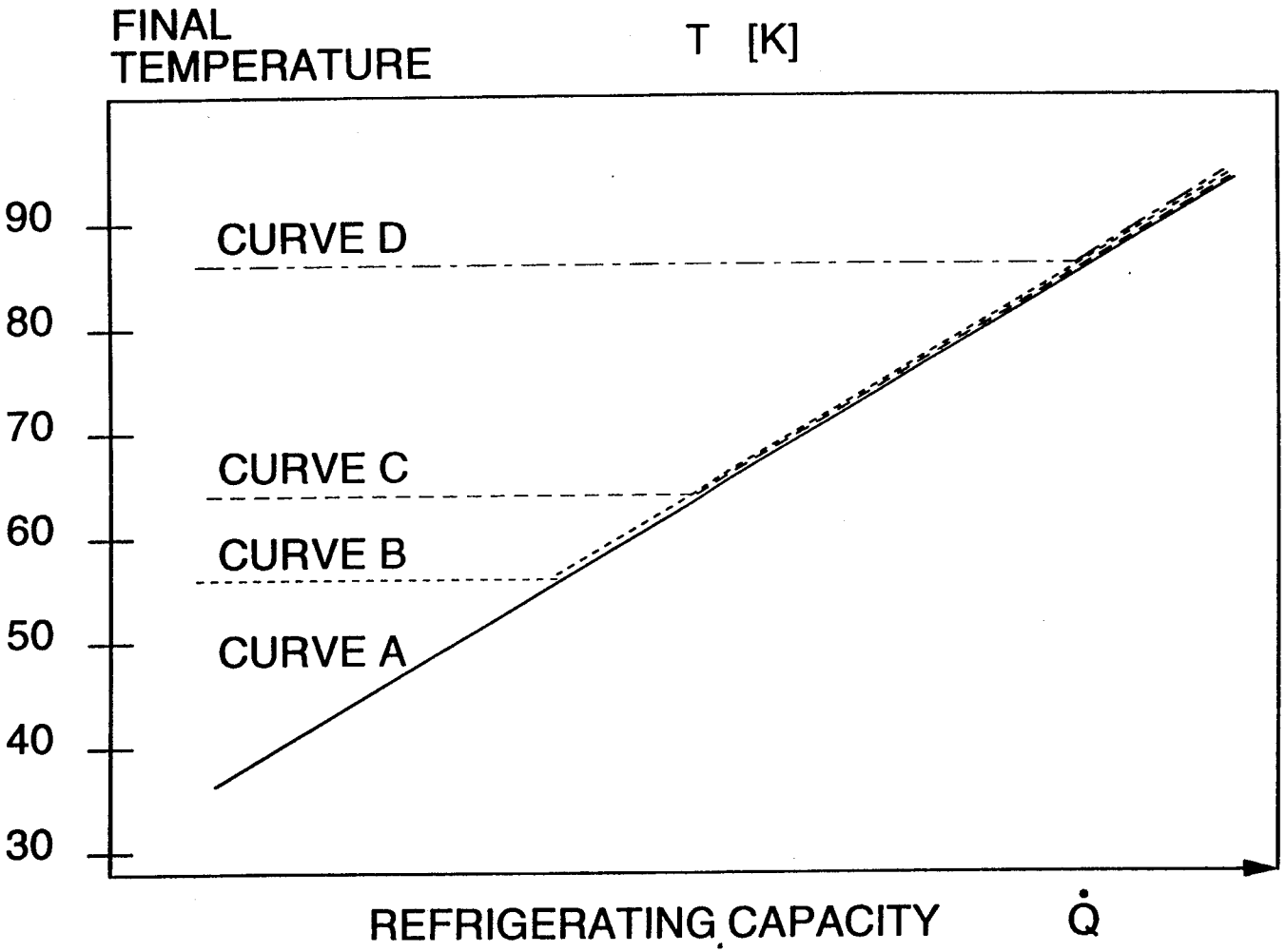
FIG. 3 is a graph showing the relationship between final temperature versus refrigerating capacity for four embodiments according to the invention.
Figure 4:
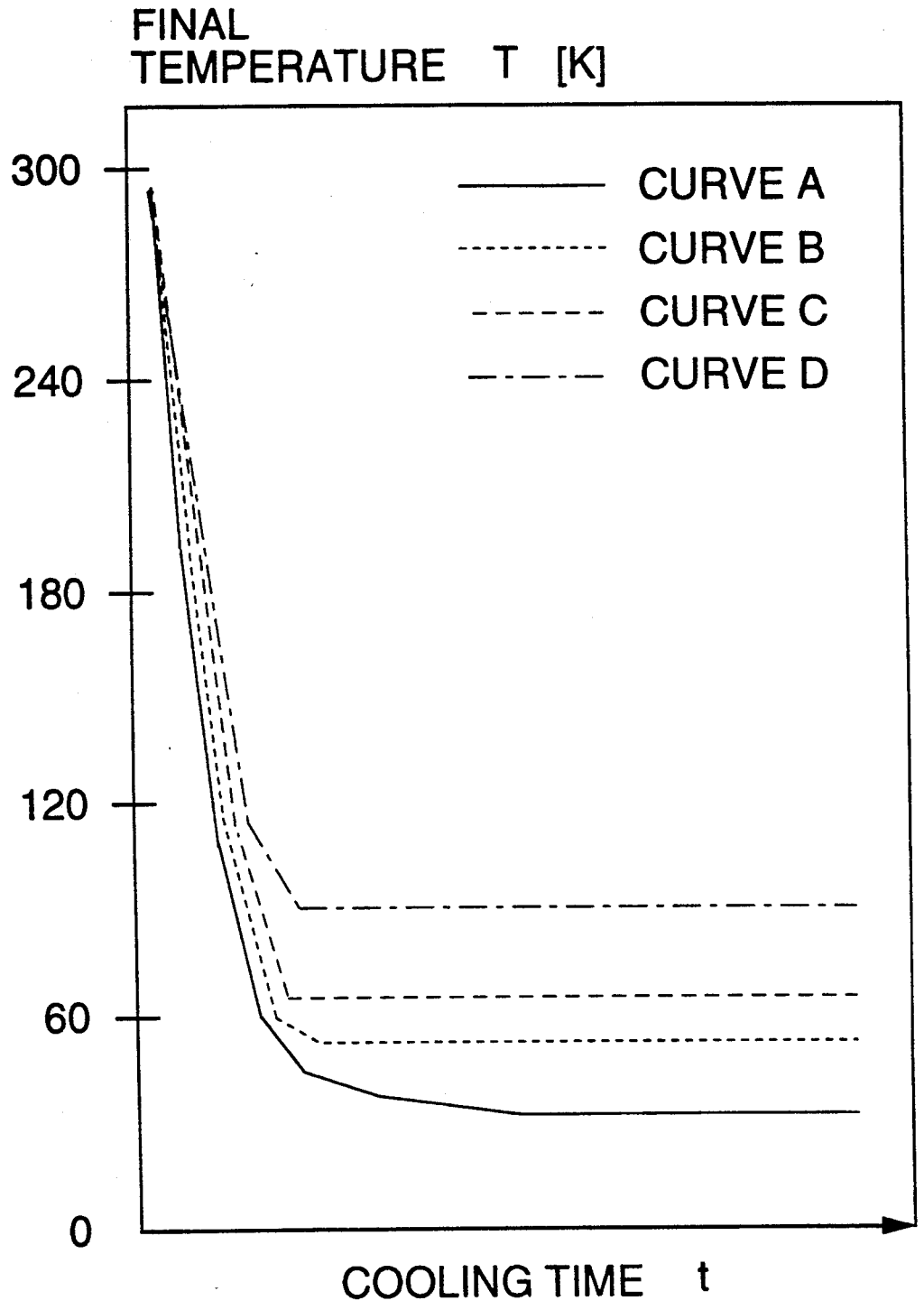
FIG. 4 is a graph showing final temperature versus cooling time for four embodiments according to the invention.

The performance characteristic of a gas refrigerating machine can be represented in both a final temperature-versus-refrigerating capacity diagram (FIG. 3) and by cooling curves at a defined thermal load (FIG. 4). In FIG. 3, the final temperature T [K]is plotted as a function of the refrigerating capacity Q, and in FIG. 4, the cooling temperature T [K]is plotted over the time axis Both representations show the performance characteristic of a gas refrigerating machine filled with: 1. pure working gas, helium (curve A), 2. a two-component gas consisting of helium and oxygen (curve B), 3. a two-component gas consisting of helium and oxygen (curve C), and 4. a two-component gas consisting of helium and argon (curve D). The constant final temperatures are clearly recognizable: T=54° K in case 2 (curve B), T=63° K in case 3 (curve C), T=84° K in case 4 (curve D), compared with T=39° K in case 1 (curve A).

Figure 5:
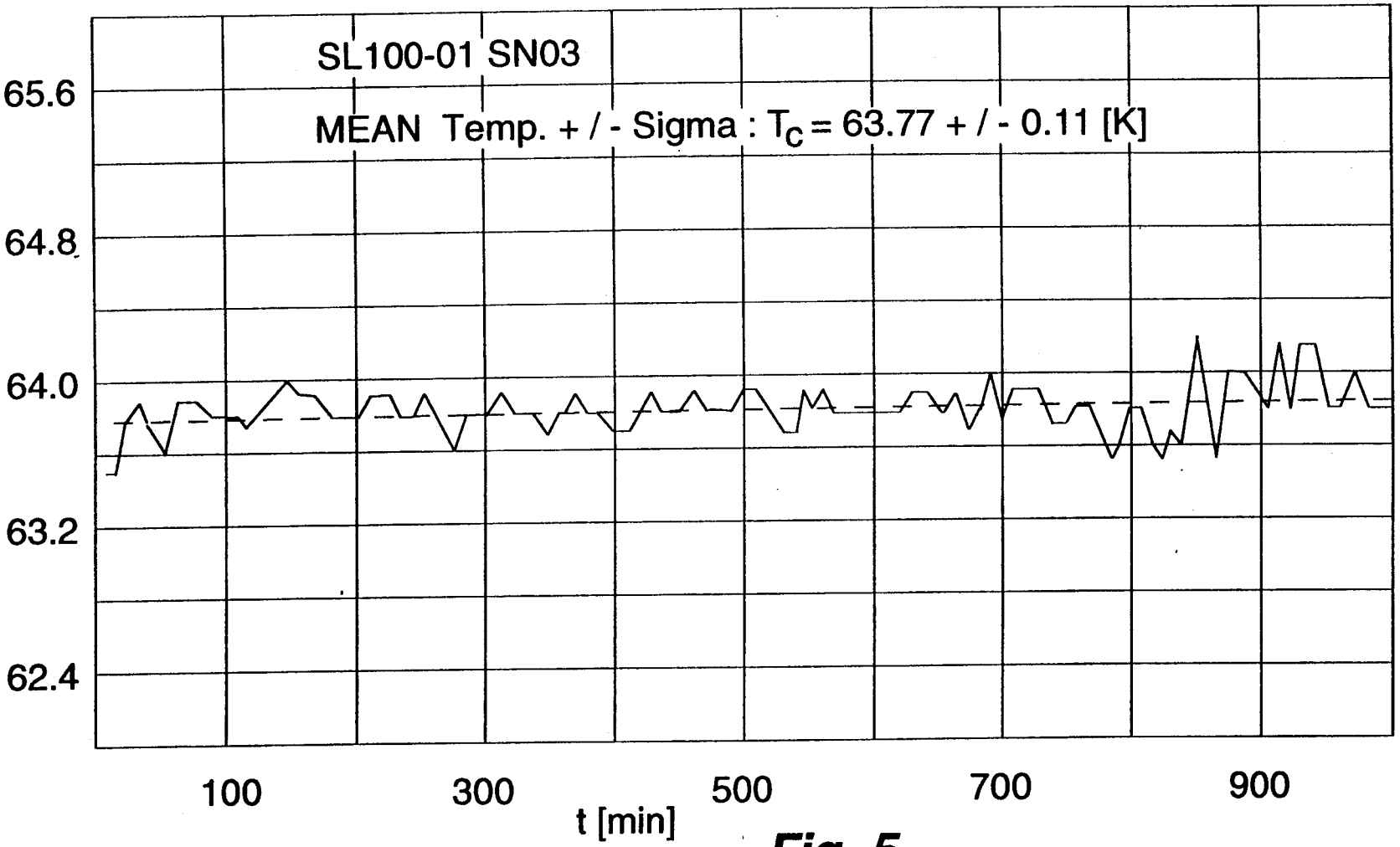
FIG. 5 is a graph showing the constancy of the final temperature with respect to time of a gas refrigerating machine filled with a two component gas consisting of helium and nitrogen over a seventeen hour period, according to the invention.

The constancy of the final temperature with a gas refrigerating machine filled with a two-component gas consisting of helium and nitrogen over a period of 17 hours is shown in FIG. 5. The mean final temperature and the standard deviation is T= 63.77° K±0.11° K in this embodiment.

While specific embodiments of the invention have been shown and described in detail to illustrate the application of the principles of the invention, it will be understood that the invention may be embodied otherwise without departing from such principles.

What is claimed is:

1. A process for cooling to a desired minimum temperature, the process comprising the steps of:

providing a regenerative gas refrigerating machine;

filling said regenerative gas refrigerating machine with a mixture of a working gas and a control gas;

controlling during said filling step the ratio of said working and control gases in said mixture to achieve a desired minimum temperature for said regenerative gas refrigerating machine; and circulating said mixture through said regenerative gas refrigerating machine to cause said mixture to cool to the point at which at least some of said control gas either condenses or solidifies to thereby control said regenerative gas refrigerating machine to maintain it at said desired minimum temperature.

2. A process according to claim 1, wherein helium is used as said working gas.

3. A process according to claim 1, wherein a gas mixture is used as said control gas.

4. A process according to claim 1, wherein oxygen is used as the control gas.

5. A process according to claim 1, wherein nitrogen is used as the control gas.

6. A process according to claim 1, wherein argon is used as the control gas.

7. A process according to claim 1, wherein a hydrocarbon is used as the control gas.

8. A process according to claim 1, wherein propane is used as said hydrocarbon.

9. A process for cooling a thermal load to a desired minimum temperature, comprising the steps of:

providing a regenerative gas refrigerating machine including a compressor, a heat releasing heat exchanger, a regenerator, a heat absorbing heat exchanger connected to the thermal load and an expander, forming a closed system for operating a sterling type cycle;

filling said regenerative gas refrigerating machine closed system with a mixture of a working gas and a control gas;

controlling during said filling step the partial pressure of said control gas in said mixture to achieve a desired minimum temperature for said regenerative gas refrigerating machine closed system; and operating said regenerative gas refrigerating machine with said mixture filled in said closed system of said regenerative gas refrigerating machine to cause said thermal load to cool to the point at which at least some of said control gas either condenses or solidifies thereby controlling cooling to maintain said thermal load substantially at said desired minimum temperature during continued operation of said closed system.

10. A process according to claim 9, wherein a gas mixture is used as said control 11. A process according to claim 9, wherein oxygen is used as the control gas.

12. A process according to claim 9, wherein nitrogen is used as the control gas.

13. A process according to claim 9, wherein argon is used as the control gas.

14. A process according to claim 9, wherein a hydrocarbon is used as the control gas.

15. A process according to claim 9, wherein propane is used as said hydrocarbon.

* * * * *